United States Patent [19]

Supik

[11] 4,220,106

[45] Sep. 2, 1980

[54] PROCESS AND APPARATUS FOR ANNEALING CAN BODIES

[75] Inventor: Helmuth Supik, Braunschweig, Fed. Rep. of Germany

[73] Assignee: Schmalbach-Lubeca GmbH, Braunschweig, Fed. Rep. of Germany

[21] Appl. No.: 933,936

[22] Filed: Aug. 15, 1978

[51] Int. Cl.[3] ..... B21D 51/00; H05B 5/00

[52] U.S. Cl. ..... 113/120 Y; 72/38; 113/120 R; 113/7 A; 113/29; 148/12 D; 219/10.69; 219/10.43; 219/64

[58] Field of Search ..... 113/1E, 7 A, 14 R, 29, 113/30, 120 Y, 120 AA, 120 R, 120 H; 72/38, 348; 219/10.69, 64, 72, 74, 10.43, 8.5; 148/12 R, 12 D, 127

[56] References Cited

U.S. PATENT DOCUMENTS

| | | | |
|---|---|---|---|
| 1,981,629 | 11/1934 | Northrup | 219/10.43 |
| 2,439,517 | 4/1948 | Johnson | 219/10.69 |
| 3,083,285 | 3/1963 | Haimbaugh et al. | 219/10.69 |
| 3,584,487 | 6/1971 | Carlson | 72/38 |
| 3,748,422 | 7/1973 | Schäfer | 219/10.43 |
| 3,964,412 | 6/1976 | Kitsuda | 113/120 H |

*Primary Examiner*—Leon Gilden
*Attorney, Agent, or Firm*—Charles E. Brown

[57] ABSTRACT

An apparatus for automatically annealing end portions of wall-ironed drawn can bodies and welded side seam can bodies formed of sheet steel to reduce stresses therein wherein the end portions may be flanged without cracking, wrinkling or folding. The can bodies are moved along a continuous path by a rotary table and are supported for rotation about their own axes during such movement. Associated with each rotating can body is a blowing hood for developing a protective gas atmosphere surrounding the portion of the can body to be annealed. The blowing hoods and associated can body upper end portions pass through an annealing zone defined by an elongated induction loop. The apparatus is particularly useful in annealing processes for sheet metal formed of unkilled steel.

16 Claims, 3 Drawing Figures

PROCESS AND APPARATUS FOR ANNEALING CAN BODIES

This invention relates in general to a process of and an apparatus for the forming of can bodies wherein each can body is formed by a wall-ironing or like process of a cup-shaped blank formed of sheet metal or of sheet steel with a welded side seam, after which a free open end portion or rim of the can body is to be flanged to facilitate the securement of an end unit thereto by a conventional folding and seaming operation, the flanging possibly occurring after a preliminary necking-in process to reduce the diameter of the end portion. During the wall ironing of the cup having a starting thickness on the order of 0.30 mm to a thickness on the order of 0.10 mm, the hardness of the sheet metal due to a strain hardening will greatly increase from about 55 to approximately 75 HR 30T. Welded side seams also have an undue hardening which causes cracking.

In most instances, the sheet metal involved will be formed of steel cast unkilled, although killed steel may be used, and even steel produced by a continuous casting process could be utilized.

The use of unkilled steel is rather attractive in that it is relatively cheap and thus would offer greater economic advantages for the mass production of cans. However, it is not too easily deformed with the result that in the past the scrap loss has been too great due to the formation of wrinkles and cracks in the flanging process.

Sheet metal from killed steel, due to its better properties for deformation, has proven to be a much more reliable raw material, particularly with respect to necking in and flanging after forming by a wall ironing process or side seam welding, but such steel is relatively expensive. This is also true with respect to steel sheets formed from continuously cast steel, although the cost is greater and the reliability of deforming operations is less.

The deforming behavior of these types of steel is especially critical during the flanging thereof, particularly when the flanging is accomplished directly without a preliminary necking-in in that at this time the material is stretched beyond the normal diameter of the can and the sheet metal is subjected to heavy stresses and strains.

Experience gained during the formation of can bodies of killed steel has shown that one will not always be successful in the preparation of a can body without the formation of folds and wrinkles in the region of the necking-in and without the formation of cracks during flanging, so that the flange width prescribed for certain can bodies can be generated only in a very troublesome manner. On the other hand, if the flange width is less than the prescribed value, then during the closing of the can end by the application of an end unit through a double seaming operation, a smaller overlapping with occur at the seam to the extent that the same will not be of sufficient size that commonly employed rails and the like utilized for carrying a number of cans cannot be reliably utilized. Thus, it is necessary to extend the region of the necking-in of the sheet metal at the rim or end portion of the can body. However, any extending of the region of necking-in brings with it the risk of an increased fold and wrinkle formation. During the flanging operation, the metal becomes stretched and thus leads to a strain hardening and thus a lowering of the elastic limit. This means that the can bodies which are wall ironed from sheet metal of killed steel according to customary procedures of the prior art will have to be about 50% thicker than the remaining cylindrical portion of the can in the region of the necking-in and flanging. Much of this thickening goes into scrap when trimming occurs to bring the formed can body to the desired length.

The above set forth experience is also found to exist when steel sheets formed in a continuous casting process are utilized.

In view of the foregoing, it is the goal of this invention further to develop the procedure for the production of can bodies so that the above-discussed difficulties are overcome and the production thereof is rendered cheaper with resultant saving with respect to material as well as the ability to use cheaper sheet materials while rendering the possibility of necking-in and flanging of the end portion of the can bodies without the formation of folds and wrinkles and without the risk of the act of flanging leading to the generation of active cracks.

The above goal has been reached in accordance with the invention by prior to the necking and/or flanging of the can body rim or end portion, subjecting the end portions to annealing while retaining the annealed portions in an atmosphere of protective gas. The heating to effect annealing is preferably accomplished by induction heating.

It has been found that by effecting such an annealing operation prior to the further deformation of the can body, considerably cheaper can bodies can be formed from unkilled steel.

An additional economy with respect to material is brought about by permitting the wall thickness of the can body to be uniform throughout the height of the can body even with relatively thin walls. In other words, in accordance with this invention the prior requirement of thickened end portions to facilitate necking-in and flanging is eliminated.

It has been found that the annealing of the end portions by which a recrystallization of the structure of the steel is effected to provide better deformation is suitable for all three types of steels previously discussed, and it is immaterial as to whether the end portion of the can body is necked-in or not or whether it is thickened or remains of the same thickness as the remainder of the can body wall. In all such applications the formation of prior undesirable cracks, wrinkles and/or folds is essentially eliminated.

In all applications prior to the necking-in and/or deformation, the end portion of the body is subjected to an annealing which is preferably accomplished within a protective gas atmosphere which will protect the zone of annealing against the undesirable influence of the usual atmosphere. The annealing within the protective atmosphere greatly aids in the elimination of folds, wrinkles and cracks irrespective of the production procedure selected and irrespective of the type of steel used, in a reliable manner.

This procedure may be exploited with extraordinarily high output such as on the order of 1200 cans per minute. With this type of operation, one may advantageously pass the can bodies in a single row continuously through the annealing zone whereby each can body during such passage is rotated about its axis at a rate of generally between 200 and 3000 rpm, although it is possible to follow the procedure as an intermittent operation.

It has been found that an induction high frequency annealing is the most advantageous method. The annealing output becomes a function of the rate of rotation of the can body and the total time allowed for the annealing, and the lower the annealing output the higher the rate of rotation of the can body.

When a protective gas atmosphere is utilized, such an atmosphere is advantageously in the shape of an annular veil or sheath extending in the direction of the can body axis and over the end portion of the rotating can body in a laminar flow. Due to this laminar flow the need to enclose the can body in a chamber which contains the protective gas is eliminated. Very little of the protective gas is required because the laminar flow is such that none of the surrounding atmosphere is entrained in the gas and reaches the zone of annealing. During the actual application of this process, this manner of providing the protective atmosphere leads to the added advantage that operating steps and devices required for the encasing of the can bodies in chambers of the protective gas is eliminated.

In order to put this new procedure into operation according to the invention, one requires a stationary inductive loop which has two loop sections which are arranged parallel to one another at a mutual spacing and defines an annealing section located at a preselected distance from the plane of support and transportation for the can bodies. One also requires a conveyor which has a carrying device for each can body to effect rotation of each can body about its axis at an adjustable preselected rpm, whereby all such carrying devices may be moved by the conveyor jointly and either continuously or in steps parallel to the sections of the induction loop at a speed which is also adjustable.

It is preferred to construct the conveying means as a rotary table which is equipped adjacent the periphery thereof with spaced rotary spindles which may be driven to rotate about their axes. The spindles are equipped with supporting plates having can gripping means. At a distance above these plates which corresponds to the height of the can bodies are located the sections of the induction loop which are curved in an arc shape corresponding to the arcuate path of movement of the can bodies. They are disposed parallel to the plane of movement of the tops of the can bodies and are spaced a sufficient distance from the upper end portions so that can bodies rotating at a rather high speed are free of movement such as to contact the induction loop sections.

In the employment of a protective gas atmosphere one preferably coordinates the flowing of the protective gas to the passage of the can body through the annealing zone. The blowing device is preferably equipped with a blowing nozzle which is annular for the generation of the annular laminary gas veil in the region of the annealing zone. For this purpose there is provided a blowing hood which is stationary relative to the rotary table and the hood is equipped with a blowing nozzle having a mean diameter corresponding to the can body diameter and is directed downwardly from above the can body path of travel. It is to be understood that the blowing hood is placed a short distance above the plane of the upper end of the can body so as not to interfere with the action of the induction loop. Furthermore, the blowing hood is so shaped that it is movable together with an associated can body between the sections of the induction loop while at the same time the blowing hood is under very little influence of any thermal effect of the induction loop.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
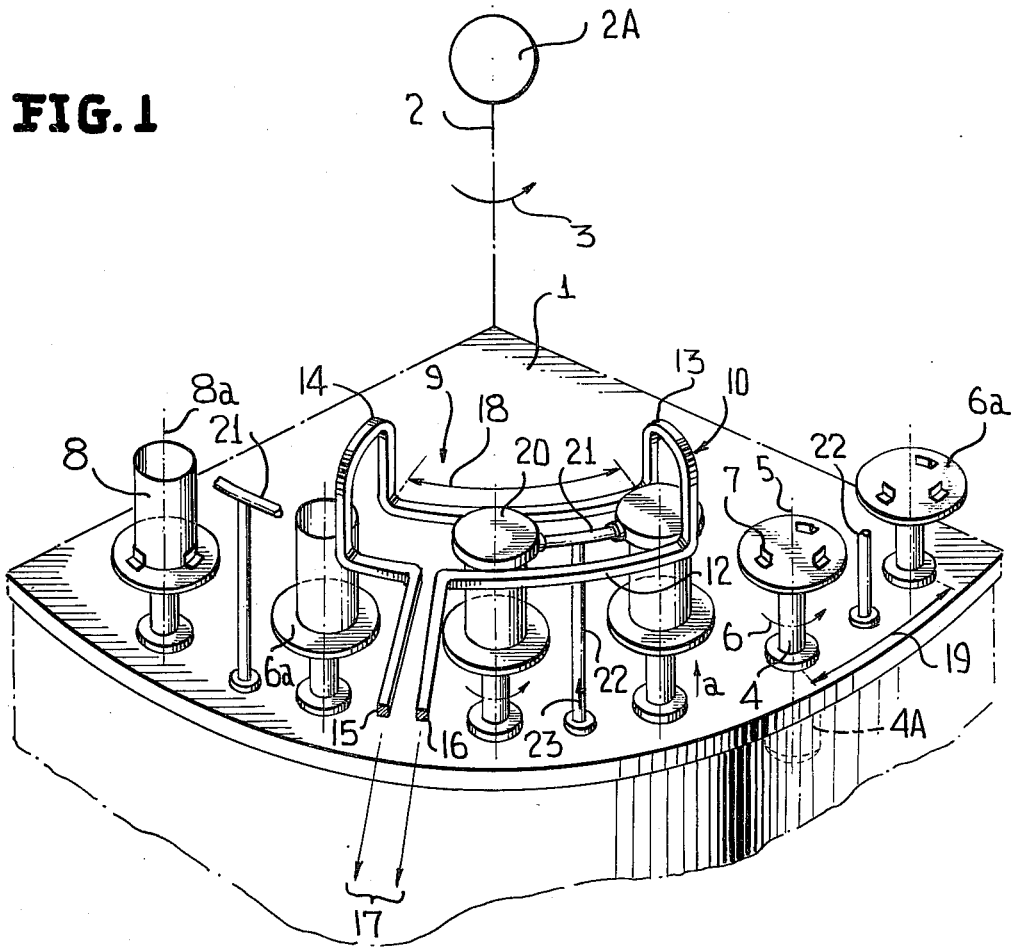
FIG. 1 is a fragmentary top perspective view of the apparatus.

In accordance with this invention, the apparatus includes a rotary table 1 which is mounted for rotation about a vertical axis 2 in the direction indicated by the arrow 3. At this time it is pointed out that the drive means for the table 1 is of a conventional type which will be adjustable in speed and may be utilized either to continuously rotate the table 1 or effect a step-by-step advancement thereof.

The rotary table 1, near its periphery, is provided with a plurality of upstanding spindles 4 which are driven by suitable drive devices 4A mounted beneath the table 1. Only one such driving device 4A is illustrated, although there will be one driving device for each spindle or each pair of spindles. Each driving device 4A will be operable to drive the respective spindle about its axis 5 in the direction indicated by the arrow 6 at a selected variable rpm. Each spindle 4 will be provided at its upper end with a support plate *6a* which receives the bottom of the can body to be carried thereby. Each plate *6a* is equipped with conventional centering and clamping devices 7. It is to be understood that it is essential that a can body 8 carried by a support plate *6a* be so positioned that its axis *8a* is accurately aligned with the axis 5 of the spindle 4 and once so oriented is reliably retained in this position.

The can body 8 may be produced from sheet metal which itself was prepared from steel which was cast, killed or unkilled, and in a continuous manner. In the illustrated embodiment it is to be assumed that each can body 8 is formed of one such steel sheets by the wall ironing of a cup-shaped blank. The can body could be formed with a welded side seam. In the typical can body 8, the wall thickness is constant throughout the height thereof, although it is envisioned that the upper open free end portion of the can body may be of a slightly greater thickness than the remainder of the can body. It is known in the prior art and commonly practiced to deform the rim or free edge portion of the can body into a flange which is folded together with a peripheral edge portion of the rim or an end unit to create a double seam which secures the end unit to the can body in sealed relation. It is to be understood that in the past even if the end portion of the can body is necked in, flanging cracks have been unavoidable when the can bodies are formed from killed steel sheets. There is, of course, more cracking if the necking-in is not first effected. If one necks-in the end portion, which normally is already thicker than the remainder of the can body, this will result in the formation of small folds and wrinkles which frequently leads to difficulties in obtaining good seals in the double seam.

On the other hand, when one utilizes the apparatus shown in FIG. 1, these deficiencies are generally eliminated even when the can bodies 8 are formed from unkilled steel sheets and have a uniform wall thickness throughout the height thereof.

In order to accomplish this desirable result, the device is equipped with an annealing section 9 which is in the form of an induction loop 10 of an induction high-frequency heating device. In the illustrated example, the induction loop 10 is supported exteriorly of the rotary table 1 so that it remains stationary with respect to the rotary table. The induction loop 10 has outwardly extending ends 15, 16 which are connected to a source of high-frequency electrical energy which is schematically indicated by the numeral 17.

The induction loop 10 is shaped to consist essentially of two induction loop sections 11 and 12 which are parallel (concentric) to each other, are part circular arcs, and extend horizontally. At their ends they are connected together by inlet and outlet sections 13, 14 in the form of arches. The annealing region is defined by the length of the parallel loop sections 11, 12. This length, which is indicated by the arrow headed line 18, may be such that a number of can bodies may be present simultaneously in the annealing region.

As stated above, the rotary table 1 may be driven intermittently, but preferably is driven continuously at an rmp which has been tuned to the rate of rotation of the spindles 4. A suitable driving unit has been schematically illustrated and is identified by the numeral 2A.

Preferably the rim or upper edge portion of the can body, when it passes through the annealing region 9, is subjected to the action of an atmosphere of protective gas.

The spindles 4 are caused to rotate prior to the arrival of the respective can body at the annealing zone 9. Aligned with each of the supporting plates **6*a* in a vertical sense and spaced above the surface of the supporting plate 6*a* a distance in accordance with the height of the can body to be annealed, is a blowing hood generally identified by the numeral 20. In the illustrated example, two like blowing hoods 20 are connected together in a circumferential direction by a distributor pipe 21 for the protective gas whereby the pipe 21** serves simultaneously to support the two adjacent blowing hoods.

The distributor pipe thereby forms an upper transverse arm of a T-shaped pipe arrangement having a vertical web section 22 which by a suitable coupling (not shown) carried by the rotary table 1 is connected to a source of protective gas (also not shown). The protective gas thus flows up through the pipe section 22 in the direction of the arrow 23 and then horizontally through the distributor section into each of the two blowing hoods.

The blowing hoods 20 are so shaped that they may pass through the annealing region 9. As will be apparent from FIG. 2, the blowing hood 20 is constructed to define an annular nozzle 32 which opens downwardly toward the rim or free edge region of the can body 8. The protective gas is fed toward the nozzle 32 after being collected in an upper chamber 31. It is to be noted that the nozzle 32 has two separate openings 33, 34 defined by an intermediate separator so as to provide a laminar flow 35, 36 on opposite sides of the can body wall. Thereby the nozzle 32 is arranged with respect to the free edge of the can body 8 so that the protective gas flows gently on both sides of the free edge portion region which is to be annealed for a height indicated by the arrow 30 in FIG. 2. Due to the shape of the nozzle 32 and the laminar flow of protective gas effected thereby, the protective gas atmosphere is very stable and only a limited amount of gas has to be supplied in the region of the can body end portion. The relationship of the nozzle to the can body end portion is so established that entrained air from the surrounding atmosphere into the protective gas atmosphere is avoided.

Figure 2:
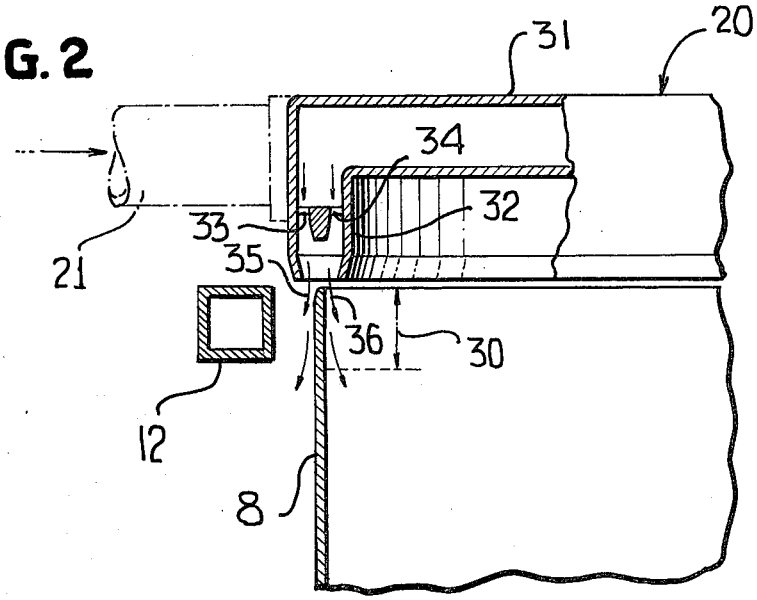
FIG. 2 is an enlarged fragmentary sectional view showing the relationship of the blowing nozzle, an upper end of a can body being annealed, and one of the induction loop sections.

In FIG. 2 there has also been illustrated a portion of the induction loop section 12. Also, there has been illustrated a portion of the distributor pipe 21 which has actually been illustrated 90° out of phase so as to illustrate the relative heights of the induction loop section and the pipe 21.

The rotary speed of the table 1 is adjusted to the length of the induction loop and the speed of rotation of the spindles 4 so that an annealing temperature of between 720° and 740° C. is obtained. It is to be understood that this annealing temperature can be obtained at a nominal power output of the induction loop with the annealing time being on the order of 0.05 and 1 second with the annealing time being greater for the slower rotation of the spindles 4 and lesser for higher rotary speeds of the spindles.

Figure 3:
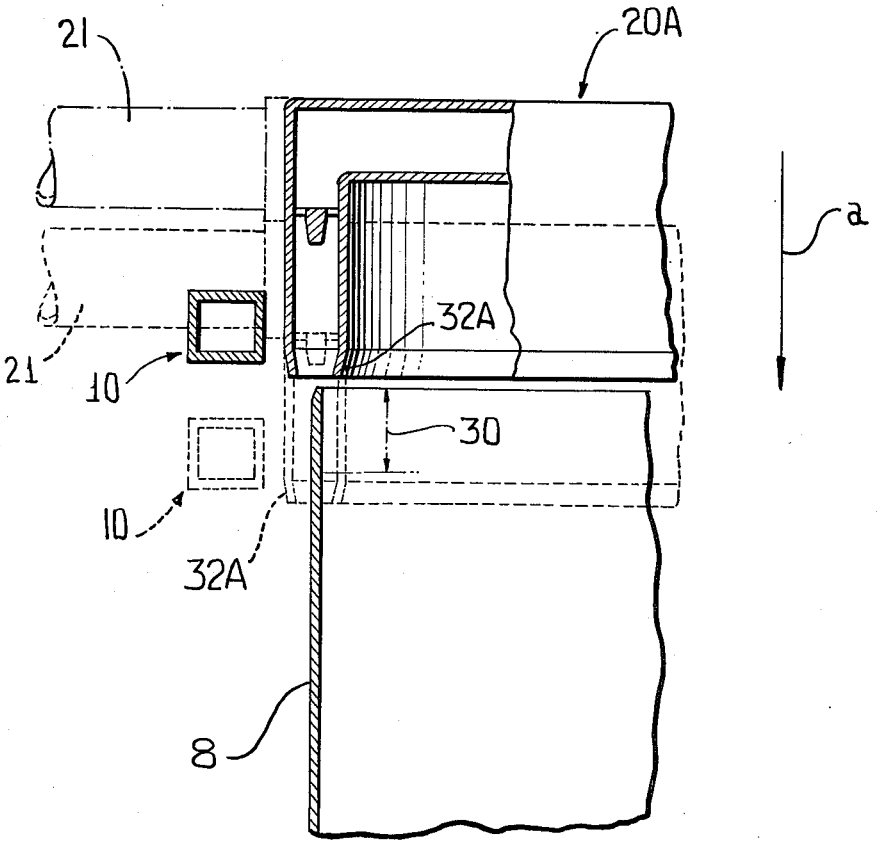
FIG. 3 is another enlarged fragmentary sectional view showing the hood being movable relative to the can body.

Referring now to FIG. 3, it will be seen that a modified form of blowing hood 20A is illustrated. It is to be understood that the blowing hood 20A has an elongated nozzle 32A as compared to the nozzle 32 of the blowing hood 20. It is also to be noted that the separator ring which divides the nozzle into two separate openings is recessed further in the nozzle 32A than it is in the nozzle 32. This permits telescoping of the spindle end portion of the can body 8 into the nozzle 32A, as shown in phantom lines in FIG. 3 to assure the maintaining of a protective atmosphere around the upper portion of the can body which is to be annealed.

In FIG. 3, as indicated by the arrow a, the blowing hoods 20A are mounted for vertical reciprocatory movement. This can be accomplished by mounting the pipe section 22 for vertical movement within the rotary table 1 and providing suitable cam means (not shown) for effecting the vertical reciprocation of the pipe section 22 in timed relation to the rotation of the table 1.

It is to be understood that the respective blowing hood 20A should be telescoped over the upper end portion of the can body 8 prior to its being annealed by passage through the induction loop 10. Accordingly, it is necessary that the blowing hood 20A be formed of a material which will not be affected by the influence of the induction loop 10.

In FIG. 3 the induction loop 10 is illustrated as being vertically movable together with the blowing hood 20A. Accordingly, if so desired, ends 15, 16 may be mounted on a suitable vertically movable support (not shown). On the other hand, it will be apparent that the induction loop 10 could remain fixed while the blowing hoods 20A are vertically reciprocated.

Returning to FIG. 1, it will be seen that there is illustrated an arrow b adjacent one of the support plates **6*a*. It is to be understood that the induction loop 10 and the blowing hoods 20A can be fixedly mounted and the support plate 6*a* be vertically movable. This merely requires the mounting of the spindles 4 relative to the table 1 for such vertical movement, either with or relative to the associated drive unit 4A. Suitable conventional cam means (not shown) may be utilized for effecting the raising and lowering of the support plates 6a in timed relation to the rotation of the table 1**.

Further, although the apparatus is particularly adapted for the annealing of drawn or wall ironed can bodies formed of sheet steel, it is to be understood that similar cracking problems have been experienced when can bodies are formed of like sheet steel but with welded side seams. Not only does the use of the specific steel cause a folding and cracking problem in the case of necking-in and flanging, the seam welding further causes cracking problems during the flanging due to the hardness of the welded seam and the lesser strength of the adjacent metal.

I claim:

1. In the process of forming a can body of steel sheet wherein the can body has a free open end portion to be flanged preparatory to the securement of an end unit thereto by a folding and seaming operation; the method of annealing the free open end portion by heating the free open end portion to an annealing temperature while simultaneously generating an inert gas atmosphere around the free open end portion, said heating being effected by fixed inductive heating means while continuously moving the can body along a predetermined path and rotating each can body about its axis while being heated.

2. The process of claim 1 wherein the can body has a generally longitudinal axis and the can body is rotated about its longitudinal axis during said annealing.

3. The process of claim 2 wherein said inert gas atmosphere is developed as an annular sheath centered on the can body.

4. The process of claim 1 wherein said inert gas atmosphere is developed as an annular sheath centered on the can body.

5. The process of claim 2 wherein the can body is rotated at a speed on the order of between 200 and 3000 rpm.

6. The process of claim 2 wherein the can body is rotated at a speed on the order of 200 rpm and is heated for a period on the order of 1 second.

7. The process of claim 2 wherein the can body is rotated at a speed on the order of 3000 rpm and is heated for a period on the order of 0.1 second.

8. The process of claim 1 wherein said inert gas atmosphere is developed as an annular sheath centered on the can body and moving along the predetermined path with the can body.

9. Apparatus for annealing a free open end portion of a seamless can body preparatory to flanging the same, said apparatus comprising heating means fixedly positioned along a predetermined path, conveyor means for continuously moving can bodies serially along said predetermined path, and means for providing an inert gas atmosphere for each can body during the passage thereof past said heating means and means for rotating each can body about its axis during the movement thereof past said heating means.

10. The apparatus of claim 9 wherein said means for providing an inert gas atmosphere is carried by said conveyor means for movement in unison with a respective can body.

11. The apparatus of claim 10 wherein said means for providing an inert gas atmosphere includes a blowing hood having an annular nozzle corresponding in size to the diameter of the intended can body.

12. The apparatus of claim 11 wherein said conveyor means includes individual can body supports each aligned with a respective one of said nozzles.

13. The apparatus of claim 12 together with means for rotating said can body supports.

14. The apparatus of claim 12 wherein said conveyor means is in the form of a rotary table.

15. The apparatus of claim 9 wherein said heating means is an induction heater including two elongated loop sections lying on opposite sides of said path.

16. The apparatus of claim 12 wherein means mount said can body supports and said nozzles for relative movement toward and away from one another to effect telescoping of ends of can bodies within respective nozzles.

* * * * *